United States Patent [19]

Thompson

[11] 4,085,954

[45] Apr. 25, 1978

[54] SLAT ASSEMBLY FOR CHAIN LINK FENCE

[76] Inventor: Omer A. Thompson, 25080 S.E. Hwy. 212, Boring, Oreg. 97009

[21] Appl. No.: 583,918

[22] Filed: Jun. 5, 1975

Related U.S. Application Data

[63] Continuation of Ser. No. 475,669, Jun. 3, 1974, abandoned.

[51] Int. Cl.[2] ..... B21F 27/00

[52] U.S. Cl. ..... 256/34

[58] Field of Search ..... 256/32, 34, 21, 22, 256/47

[56] References Cited

U.S. PATENT DOCUMENTS

| | | | |
|---|---|---|---|
| 1,376,150 | 4/1921 | Miller | 256/34 |
| 2,760,759 | 8/1956 | Rice | 256/34 |

*Primary Examiner*—Doris L. Troutman

*Attorney, Agent or Firm*—Oliver D. Olson

[57] ABSTRACT

A plurality of elongated slats are woven through the links of a chain link fence, in spaced parallel arrangement, and are engaged at one of their ends in an elongated channel-shaped retainer member woven through the links at an angle to the parallel slats. The ends of the slats opposite the retainer member preferably engage an elongated abutment member which may be another retainer member, or another slat, woven through the links parallel to the first named retainer member.

2 Claims, 4 Drawing Figures

SLAT ASSEMBLY FOR CHAIN LINK FENCE

This is a continuation of application Ser. No. 475,669, filed June 3, 1974, now abandoned.

BACKGROUND OF THE INVENTION

This invention relates to chain link fences, and more particularly to a slat assembly for incorporation with chain link fencing.

Wooden slats heretofore have been incorporated with chain link fences, by weaving them through the links of the fence, for the purpose of increasing the privacy afforded by the fence. However, such wooden slats tend to shift longitudinally and thus become disarranged unevenly, presenting an unsightly appearance. This has been overcome in some instances by securing the slats to the fence links, as by staples, nails, etc. Such procedure is time-consuming and therefore costly. Moreover, it renders difficult, time-consuming and costly the replacement of broken or otherwise damaged slats.

Further, wooden slats, whether natural, stained, or painted, deteriorate with continued exposure to the elements, and their attractiveness can only be restored by removing them from the fence for restaining or repainting. This periodic restoration also is time-consuming and costly.

SUMMARY OF THE INVENTION

In its basic concept, this invention provides, for chain link fences, a slat assembly wherein at least one of the ends of a plurality of elongated parallel slats, woven through the links of chain link fencing, are anchored in an elongated, channel-shaped retainer member woven through the links of the fence at an angle to the parallel slats.

It is by virtue of the foregoing basic concept that the principal objective of this invention is achieved; namely, to overcome the aforementioned disadvantages of prior chain link fence and slat arrangements.

Another important object of this invention is the provision of a slat assembly which is easily incorporated with conventional chain link fencing in a variety of attractive patterns and which is easily disassembled for replacement of slats of diverse colors or for rearrangement to other patterns.

A further important object of this invention is the provision, for chain link fencing, of a slat assembly construction for economical manufacture.

The foregoing and other objects and advantages of this invention will appear from the following detailed description, taken in connection with the accompanying drawing of preferred embodiments.

DESCRIPTION OF THE PREFERRED EMBODIMENTS

Figure 2:
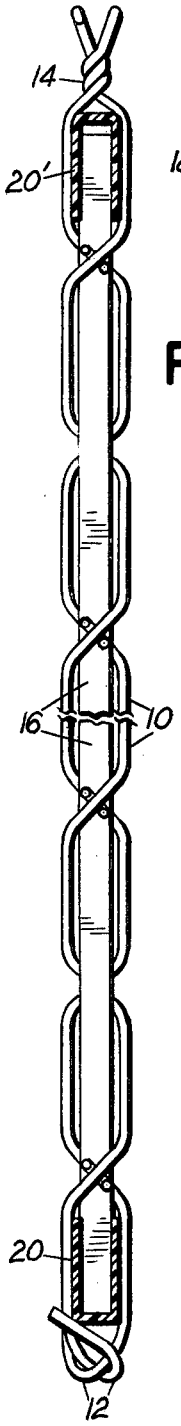
FIG. 2 is a foreshortened sectional view taken on the line 2—2 in FIG. 1.

The drawing illustrates a conventional form of chain link fencing in which elongated wires are bent in zigzag manner and interlocked one with another to form a plurality of flexible links 10. In the form illustrated, the bottom ends of adjacent wires are interconnected by reversely bent end portions 12, and the upper ends of adjacent wires are interconnected by twisting the upper portions together. These twisted upper portions 14 serve the additional function of presenting rather sharp barbs along the upper edge of the fence, to discourage attempts to climb over the fence. In an alternative fence construction, the fencing is inverted to place the twisted ends 14 at the bottom, as is well known.

In accordance with this invention, a slat assembly is provided for incorporation with chain link fencing. The slat assembly includes a plurality of elongated slats 16 disposed in spaced, parallel relationship and each woven through the links 10 of chain link fencing. In the embodiment illustrated, these slats are woven through the chain links so as to extend vertically relative to the fence.

The slats may be made of wood, as heretofore. However, the slats preferably are made of flexible synthetic thermoplastic resin formed by the rapid and inexpensive extrusion process well known in the art. In this manner, coloring material may be incorporated in the resin prior to extrusion, to provide finished slats of permanent and diverse colors. This not only eliminates periodic refinishing of the slats, but it also affords the development of slat assemblies of diverse patterns of colors, if so desired.

The extruded slats 16 illustrated (FIG. 3) are formed with a flat front surface reinforced for structural strength with a plurality of rearwardly extending, laterally spaced ribs 18. If desired, a rearward flat surface also may be provided to render the slats reversible and to provide the fence with the same appearance from both sides.

Although the thermoplastic slats are preferred for their economy, they may be provided by the extrusion of such metals as aluminum. Diverse surface colorings may be provided by anodizing, as is well known.

Figure 3:
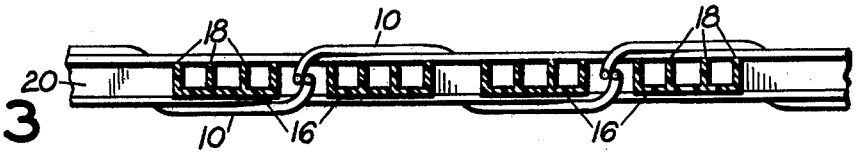
FIG. 3 is a fragmentary sectional view taken on the line 3—3 in FIG. 1.

Also in accordance with this invention, means is provided for retaining the parallel slats 16 against longitudinal displacement. For this purpose, an elongated U-shaped retainer member 20 is woven through the fence links 10 adjacent one end of the parallel slats 16 and at an angle to the latter, for reception in the retainer member of said adjacent ends of the parallel slats. In the embodiment illustrated, the retainer member is formed by the extrusion of synthetic thermoplastic resin. It is provided with spaced, parallel sides closed at one end and open at the other end. The internal width of the U-shaped members is dimensioned to receive the end portions of the parallel slats, as illustrated in FIGS. 2 and 3.

As illustrated, the retainer member 20 is woven horizontally through the bottom links 10 of the fencing for reception of the bottom end portions of the vertically extending parallel slats 16. The closed bottom end of the retainer member thus serves as an abutment for the bottom ends of the parallel slats and prevents their relative longitudinal displacement. It is to be noted from FIGS. 2 and 3 that the external thickness of the slats 16 and retainer members 20 does not exceed the corresponding thickness of the fence openings formed by the flexible links 10, whereby to accommodate their insertion flatwise through the fence openings.

If desired, an elongated abutment member may be provided at the ends of the parallel slats opposite the retainer member, to prevent longitudinal displacement of the parallel slats toward said opposite end and also to provide an attractive edging which extends parallel to the retainer member. In the embodiment illustrated in FIGS. 1 and 2, this elongated abutment member is provided by a retainer member 20' of the same cross sectional configuration as the retainer 20. In this arrangement the upper ends of the parallel slats extend into the channel of the U-shaped retainer member and terminate adjacent the closed end of the latter. Since the retainer member 20' conceals the upper portion of the parallel slats, uniformity of lengths of the latter is not critical, as indicated in FIG. 1.

Figure 4:
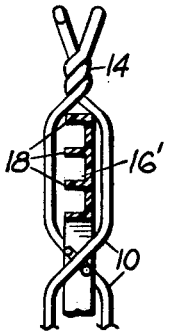
FIG. 4 is a fragmentary sectional view, similar to FIG. 2, showing an alternative slat assembly arrangement.

In the alternative embodiment illustrated in FIG. 4, the abutment member is provided by a slat 16' of the same type and configuration as the parallel slats 16 described hereinbefore. In this arrangement the upper ends of the parallel slots abut the adjacent lower edge of the abutment slat 16'. This arrangement necessitates closer tolerance of lengths of parallel slats 16 for uniform abutment against slat 16'.

Figure 1:
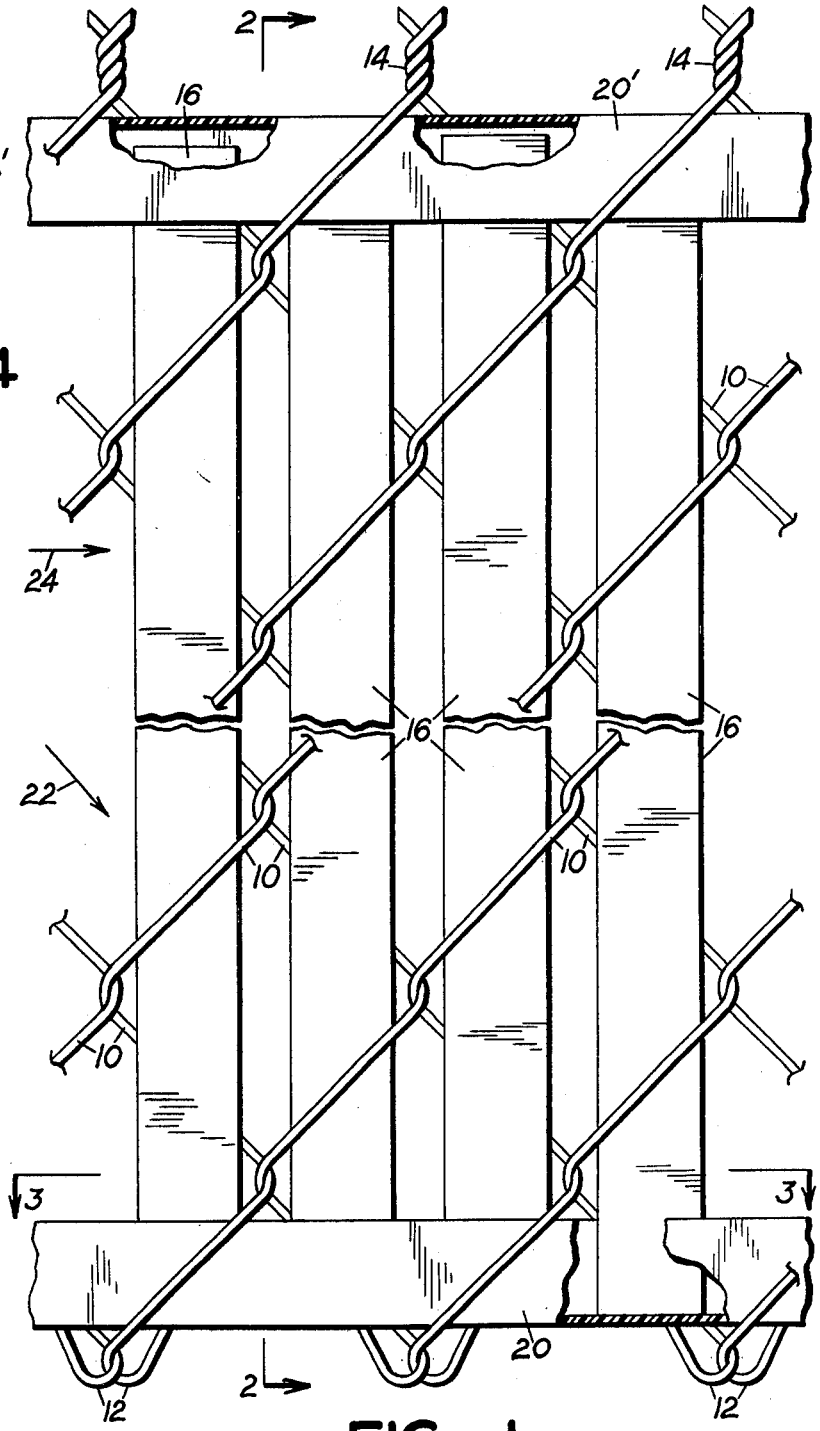
FIG. 1 is a fragmentary, foreshortened view in front elevation of a portion of chain link fencing having incorporated therewith a slat assembly embodying the features of this invention.

Although FIG. 1 of the drawing illustrates the parallel slats 16 as extending vertically relative to the fence, they may be woven through the fence links 10 in such manner as to extend diagonally, as indicated by the arrow 22. For this purpose the bottom retainer member 20 still is installed horizontally, as illustrated in FIG. 1, and the top abutment member 16' or 20' is installed parallel thereto, also as illustrated in FIG. 1.

As a further alternative arrangement, the parallel slats may be woven through the fence links to extend horizontally, as indicated by the arrow 24. In this case the opposite ends of the parallel slats preferably are retained betwen U-shaped retainer members 20 which are woven through the fence links to extend vertically relative to the fence.

The slats 16 may be precut for use with chain link fencing of predetermined dimensions. Alternatively, long strips of extruded slat material may be conveyed to the site of fence installation and there cut to desired lengths. In similar manner, the elongated retainer member 20 and abutment member 16' or 20' may be precut, or cut from long strips to desired length.

As mentioned hereinbefore, the slats may be provided in a variety of colors and arranged singly or in groups of different colors, as desired, in a variety of attractive arrangements. These arrangements may be modified from time to time simply by removing the abutment member 16' or 20' and the parallel slats 16 and reweaving the latter in a different pattern. This may be done quickly and therefore at minimum cost, and without damage or disfigurement of the components of the slat assembly.

From the foregoing it will be appreciated that the present invention provides for incorporation with chain link fencing a slat assembly which is of simplified construction for economical manufacture, which is capable of assembly and disassembly with speed and facility, which may be arranged in a variety of attractive patterns, and in which the parallel slats are retained against longitudinal displacement and thereby preserved in finished appearance.

It will be apparent to those skilled in the art that various changes may be made in the size, shape, type, number and arrangement of parts described hereinbefore, without departing from the spirit of this invention.

Having now described my invention and the manner in which it may be used, I claim:

1. For use with chain link fencing, a slat assembly comprising:

a. a plurality of elongated slats proportioned to be woven flatwise through the links of chain link fencing in spaced, parallel arrangement, and b. an elongated retainer member U-shaped in cross section having an external thickness not exceeding the corresponding thickness of the fence link openings, whereby to accommodate insertion of the retainer member flatwise through the fence link openings adjacent one end of the slats and at an intercepting angle to the latter, c. the U-shaped retainer member having spaced parallel sides closed at the end away from the slat ends and open at the end facing the slats for receiving the slat ends for retention within the retainer member, the internal width of the retainer member between the spaced parallel sides thereof being substantially the same as the external flatwise width of the slats.

2. In combination with chain link fencing, a slat assembly comprising:

a. a plurality of elongated slats woven flatwise through the links of chain link fencing in spaced, parallel arrangement, and b. an elongated retainer member U-shaped in cross section having an external thickness not exceeding the corresponding thickness of the fence link openings and woven flatwise through the fence link opening adjacent one end of the slats and at an intercepting angle to the latter, c. the U-shaped retainer member having spaced, parallel sides closed at the end away from the slat ends and open at the end facing the slats and receiving the slat ends for retention within the retainer member, the internal width of the retainer member between the spaced parallel sides thereof being substantially the same as the external flatwise width of the slats.

* * * * *